US007273420B2

(12) United States Patent
Wright

(10) Patent No.: US 7,273,420 B2
(45) **Date of Patent: *Sep. 25, 2007**

(54) GOLF CLUB HEAD WITH MULTIPLE INSERT FRONT FACE

(75) Inventor: David E. Wright, Glendale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 475 days.

This patent is subject to a terminal disclaimer.

(21) Appl. No.: 11/019,816

(22) Filed: Dec. 21, 2004
(Under 37 CFR 1.47)

(65) Prior Publication Data

US 2007/0178987 A1 Aug. 2, 2007

(51) Int. Cl.
*A63B 53/04* (2006.01)

(52) U.S. Cl. ..... 473/329; 473/340; 473/332; 473/342; 473/349

(58) Field of Classification Search ..... 473/324–350
See application file for complete search history.

(56) References Cited

U.S. PATENT DOCUMENTS

| | | | | | |
|---|---|---|---|---|---|
| 1,494,494 | A * | 5/1924 | Lippincott | 473/342 |
| 3,847,399 | A * | 11/1974 | Raymont | 473/350 |
| 4,679,792 | A * | 7/1987 | Straza et al. | 473/329 |
| 4,681,322 | A * | 7/1987 | Straza et al. | 473/329 |
| 5,060,951 | A * | 10/1991 | Allen | 473/346 |
| 5,301,941 | A * | 4/1994 | Allen | 473/327 |
| 5,458,332 | A | 10/1995 | Fisher | |
| 5,482,281 | A * | 1/1996 | Anderson | 473/313 |
| 5,524,331 | A * | 6/1996 | Pond | 29/527.4 |
| 5,575,472 | A | 11/1996 | Magerman | |
| 5,766,093 | A * | 6/1998 | Rohrer | 473/329 |
| 5,807,190 | A | 9/1998 | Krumme | |
| 5,842,935 | A | 12/1998 | Nelson | |
| 6,001,030 | A * | 12/1999 | Delaney | 473/329 |
| 6,093,116 | A * | 7/2000 | Hettinger et al. | 473/332 |
| 6,277,033 | B1 * | 8/2001 | Krumme et al. | 473/342 |
| 6,302,807 | B1 * | 10/2001 | Rohrer | 473/329 |
| 6,375,583 | B1 | 4/2002 | Solheim | |
| 6,390,932 | B1 * | 5/2002 | Kosmatka et al. | 473/324 |
| 6,431,997 | B1 * | 8/2002 | Rohrer | 473/324 |
| 6,478,694 | B2 | 11/2002 | Anderson | |
| 6,592,467 | B1 * | 7/2003 | Gray | 473/332 |
| 6,659,883 | B2 | 12/2003 | Nelson | |
| 6,699,140 | B1 * | 3/2004 | Sun | 473/252 |
| 6,932,716 | B2 * | 8/2005 | Ehlers et al. | 473/329 |

* cited by examiner

*Primary Examiner*—Sebastiano Passaniti
(74) *Attorney, Agent, or Firm*—Darrell F. Marquette

(57) ABSTRACT

A golf club head has a cavity for receiving a face insert. A first face insert, which is disposed in the cavity, has a front surface that is contoured. A second face insert composed of multiple rod elements is disposed in the cavity on top of the first face insert so that the rod elements are supported by the contoured front surface of the first face insert. Because the first face insert supporting the rod elements is contoured, the individual rod elements are of different lengths and, therefore, exhibit different dynamic responses when striking a golf ball, even when the rod elements are made of the same material.

23 Claims, 4 Drawing Sheets

GOLF CLUB HEAD WITH MULTIPLE INSERT FRONT FACE

BACKGROUND OF THE INVENTION

This invention relates generally to golf equipment and, in particular, to golf club heads.

In order to improve the "feel" of golf clubs, especially putters, golf manufactures have frequently provided a face insert on the front face of the club head. Early golf clubs had face inserts made of cork, wood, rubber, or gutta-percha. More recent examples of golf clubs having face inserts include U.S. Pat. No. 5,575,472 to Magerman et al which discloses a putter head with a recess into which is poured a polymer resin that is cured and subsequently milled to produce the putter head. U.S. Pat. No. 5,524,331 to Pond discloses a metal club head with a cast graphite epoxy composite insert, and U.S. Pat. No. 5,458,332 to Fisher discloses a putter head having a polyurethane face insert with specific hardness and resiliency properties.

U.S. Pat. No. 5,807,190 to Krumme et al. discloses a club head in which a face insert is actually composed of many small rods arranged in a closely packed array. According to the Krumme patent, the use of individual rods to form the front face allows the properties of the front face to vary in any pattern over the impact area simply by varying the materials out of which the individual rods are made. Use of multiple materials within the array of rods would, however, render such a golf club head non-conforming since Rule 5(*b*) of Appendix II of the U.S. Golf Association requires that the whole of the impact area of a golf club head must be of the same material. Accordingly, what is needed is a golf club head having a face insert composed of individual rod elements in which the impact response properties of the individual rod elements can be varied without varying the material forming the rod elements.

SUMMARY OF THE INVENTION

The present invention comprises a golf club head the front face of which has a cavity for receiving a face insert. According to an illustrative embodiment, a first face insert, which is disposed in the cavity, has a front surface that is contoured. A second face insert composed of multiple rod elements is disposed in the cavity on top of the first face insert so that the rod elements are supported by the contoured front surface of the first face insert. The second face insert is finished flat to form a striking surface on the front face. Because the first face insert supporting the rod elements is contoured, however, the individual rod elements are of different lengths and, therefore, exhibit different dynamic responses when striking a golf ball, even when the rod elements are made of the same material. In alternative embodiments, the first face insert may be formed into an inherently compliant structure and/or made of a compliant material such as an elastomer to further increase the variation of dynamic response across the front face.

DESCRIPTION OF THE DRAWINGS

The present invention will be better understood from a reading of the following detailed description, taken in conjunction with the accompanying drawing figures in which like references designate like elements, and in which.

DESCRIPTION OF THE INVENTION

Figure 1:
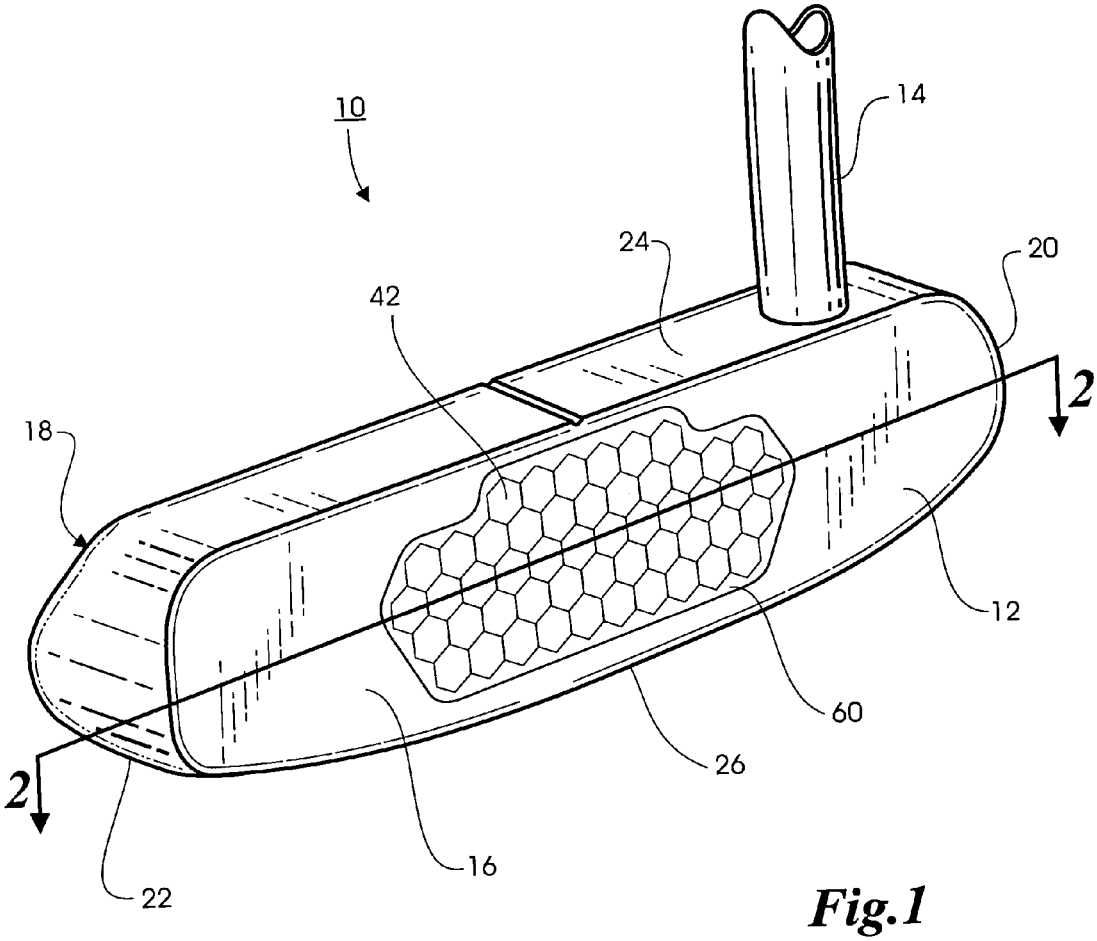
FIG. 1 is a front perspective view of a golf club incorporating features of the present invention.
Figure 2:
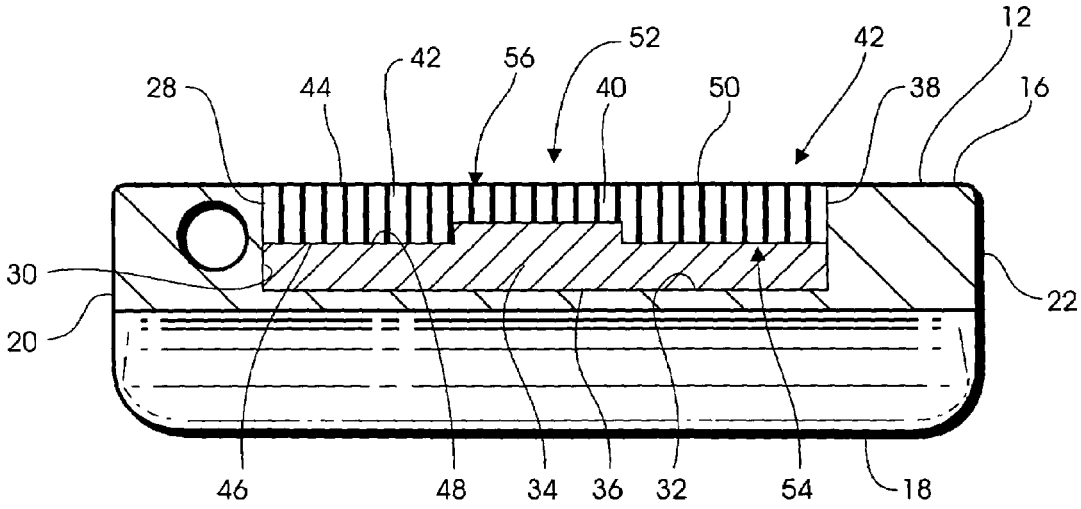
FIG. 2 is a cross-sectional view of the golf club of FIG. 1 taken along line 2-2.

With reference to FIGS. 1 and 2, a golf club 10, preferably a golf putter, comprises a club head body 12 attached to a golf club shaft 14. Typically the club head body is made of a suitable metal such as steel formed by an investment casting process, however other metal materials such as titanium, aluminum, tungsten, brass, bronze and beryllium copper may be used to form club head body 12. Those skilled in the art will recognize also that the club head body 12 may be made of other metallic or non-metallic materials without departing from the scope of the present invention. Club head body 12 has a front face 16, a rear surface 18, a heel end 20 and a toe end 22, as well as a top rail 24 and sole 26. In the illustrative embodiment, club head body 12 is formed with a cavity 28 that extends from the front face 16 toward the rear surface 18 and is defined by side wall 30 and bottom wall 32. As shown most clearly in FIG. 2, a first face insert 34 is disposed within cavity 28 such that its back surface 36 faces bottom wall 32 of cavity 28 and its lateral wall 38 abuts side wall 30 of cavity 28. First face insert 34 may be made from a rigid metallic material such as steel, titanium, aluminum, tungsten, copper and the like, or a rigid non-metallic material such as ceramic, graphite-epoxy or other composite material. Those skilled in the art, however, will recognize that first face insert 34 may be made of other materials without departing from the scope and spirit of the present invention.

A second face insert 40 is also disposed within cavity 28 atop first face insert 34. Second face insert 40 comprises a plurality of individual rod elements 42. Each of rod elements 42 has substantially the same geometry, except for the individual lengths. Accordingly, the individual rod elements are not separately described. Rod elements 42 are packed together in an array such that each side surface 44 of a rod element 42 is in contact with the side surface 44 of the adjacent rod element 42. Second face insert 40 is positioned in cavity 28 such that a bottom wall 46 of each of the rod elements 42 is supported by a front surface 48 of first face insert 34. Exposed end walls 50 of the rod elements 42 are finished flat to form the striking surface of front face 16 of club head body 12.

Because the front surface 48 of first face insert 34 is contoured so that the thickest portion of face insert 34 is proximal a center region 52 of first face insert 34, the rod elements 42 of second face insert 40 are shorter over center region 52 of first face insert 34 and are longer over the perimeter region 54 of first face insert 34. Accordingly, second face insert 40 will have a different dynamic response in the center region 52 than it will in the perimeter region 54. As noted herein before, in the illustrative embodiment of FIG. 2, first face insert 34 is composed of a rigid material so that the variation in dynamic response across the face 56 of second face insert 40 is dominated by the difference in response of the individual rod elements 42. Alternatively, however, first face insert 34 may be composed of an elastomeric material such as polyurethane to provide a compliant support for the individual rod elements 42 of second face insert 40. In this case, the dynamic response across the face 56 of second face insert 40 would be a composite of the resiliency and damping properties of the elastomeric first face insert 34 and the response of the rod elements 42.

First face insert 34 may be cast in place but is preferably cast or molded separately and pressed or bonded in place within cavity 28. Second face insert 40 may be formed of individual rods of circular cross section (not shown) but preferably comprises the plurality of rod elements 42 having a hexagonal cross section arranged in a hexagonal close-packed array surrounded by an epoxy binder 60 that holds the rod elements 42 in place as shown in FIG. 1.

Figure 3:
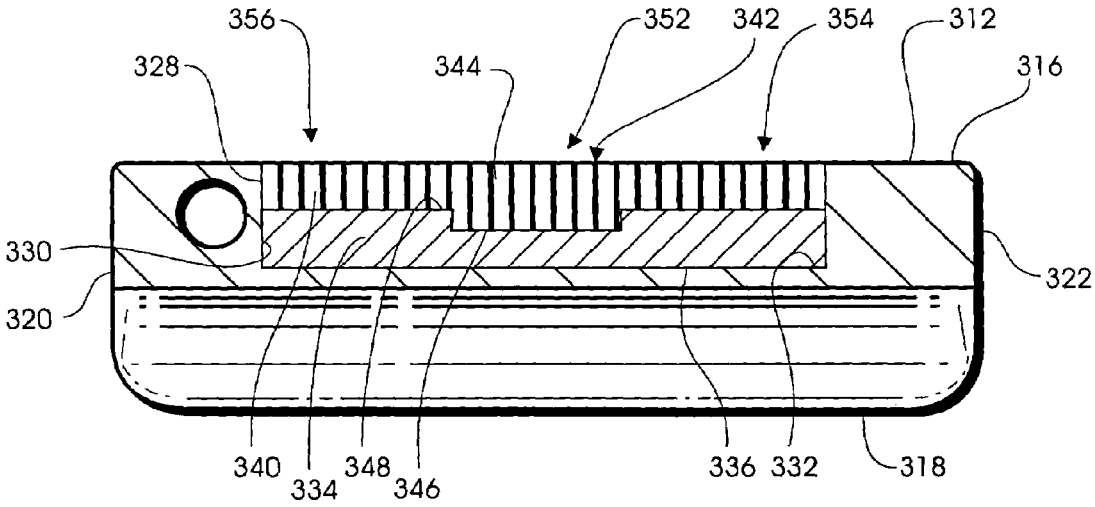
FIG. 3 is a cross-sectional view of an alternative embodiment of a golf club incorporating features of the present invention.

With reference to FIG. 3, an alternative embodiment of a golf club head incorporating features of the present invention, comprises a club head body 312 having a front face 316, a rear surface 318, a heel end 320 and a toe end 322. A cavity 328 extends from the front face 316 toward the rear surface 318 and terminates in a bottom wall 332. A first face insert 334 is disposed within cavity 328 such that the back surface 336 of first face insert 334 faces bottom wall 332 of cavity 328. The front surface 348 is contoured such that first face insert 334 is thinner proximal center region 352 and is thicker in perimeter region 354. Second face insert 340, which is composed of a plurality of rod elements 342 is disposed in cavity 328 such that the bottom end walls 346 of rod elements 342 are supported by front surface 348 of first face insert 334. As with the illustrative embodiment of FIG. 2, first face insert 334 can be made of any rigid material, in which case the dynamic response of the face is dominated by the difference between the lengths of the individual rod elements of second face insert 340. Additionally, if first face insert 334 is made of a material that is denser than the material out of which club head body 312 is composed, the distribution of material in first face insert 334 can increase the heel toe weighting of the club head without the use of visible heel and toe weights. Alternatively, as with the illustrative embodiment of FIG. 2, first face insert 334 may be composed of an elastomeric material, in which case the variation in dynamic response across the face 356 of second face insert 340 will be a composite of the variation in dynamic response of the individual rod elements as well as the response of the compliant substrate of first face insert 334.

Figure 4:
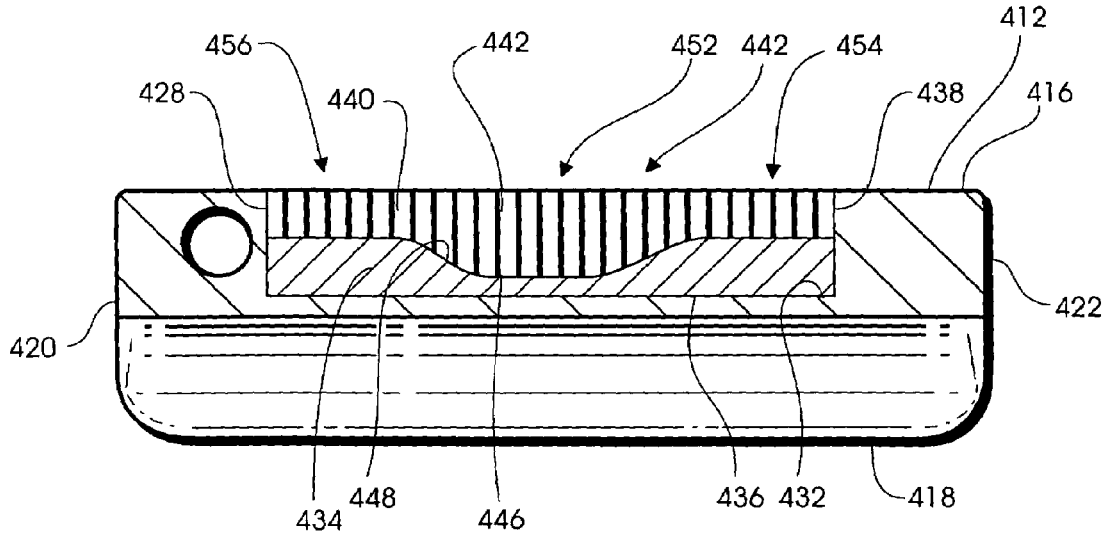
FIG. 4 is a cross-sectional view of another alternative embodiment of a golf club incorporating features of the present invention.

With reference to FIG. 4, an alternative embodiment of a golf club head incorporating features of the present invention, comprises a club head body 412 having a front face 416, a rear surface 418, a heel end 420 and a toe end 422. A cavity 428 extends from the front face 416 toward the rear surface 418 and terminates in a bottom wall 432. A first face insert 434 is disposed within cavity 428 such that the back surface 436 of first face insert 434 faces bottom wall 432 of cavity 428. The front surface 448 is smoothly contoured such that first face insert 434 is thinner proximal center region 452 and becomes gradually thicker in perimeter region 454. Second face insert 440, which is composed of a plurality of rod elements 442 is disposed in cavity 428 such that the bottom end walls 446 of rod elements 442 are supported by front surface 448 of first face insert 434. As with the illustrative embodiment of FIG. 2, first face insert 434 can be made of any rigid material, in which case the dynamic response of the face is dominated by the difference between the lengths of the individual rod elements of second face insert 440. Additionally, if first face insert 434 is made of a material that is denser than the material out of which club head body 412 is composed, the distribution of material in first face insert 434 can increase the heel toe weighting of the club head without the use of visible heel and toe weights. Alternatively, as with the illustrative embodiment of FIG. 2, first face insert 434 may be composed of an elastomeric material, in which case the variation in dynamic response across the face 456 of second face insert 440 will be a composite of the variation in dynamic response of the individual rod elements as well as the response of the compliant substrate of first face insert 434.

Figure 5:
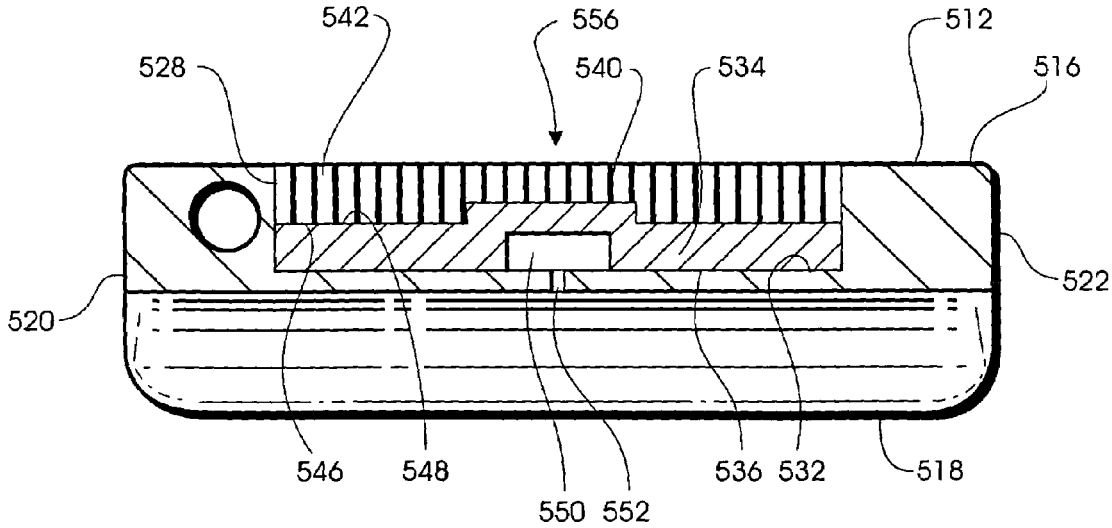
FIG. 5 is a cross-sectional view of another alternative embodiment of a golf club incorporating features of the present invention.

With reference to FIG. 5, an alternative embodiment of a golf club head incorporating features of the present invention, comprises a club head body 512 having a front face 516, a rear surface 518, a heel end 520 and a toe end 522. A first face insert 534 is disposed within cavity 528 such that the lower surface 536 of first face insert 534 faces bottom surface 532 of cavity 528. As with the illustrative embodiment of FIG. 2, second face insert 540 is disposed in cavity 528 such that the bottom end walls 546 of rod elements 542 are supported by a front surface 548 of first face insert 534. As with the illustrative embodiment of FIG. 2, first face insert 534 can be made of a rigid or elastomeric material depending upon the desired club head response. Back surface 536 of first face insert 534 is also contoured to provide a back cavity 550 in first face insert 534. Rear surface 518 of club head body 512 includes an aperture 552 that opens into cavity 550 which permits cavity 550 to act as an air-dashpot to further tailor the response characteristics of the face 556 of second face insert 540 when striking a golf ball. Alternatively, a third material, such as a highly viscous silicone gel may be injected into back cavity 550 to provide a different response characteristic.

Figure 6:
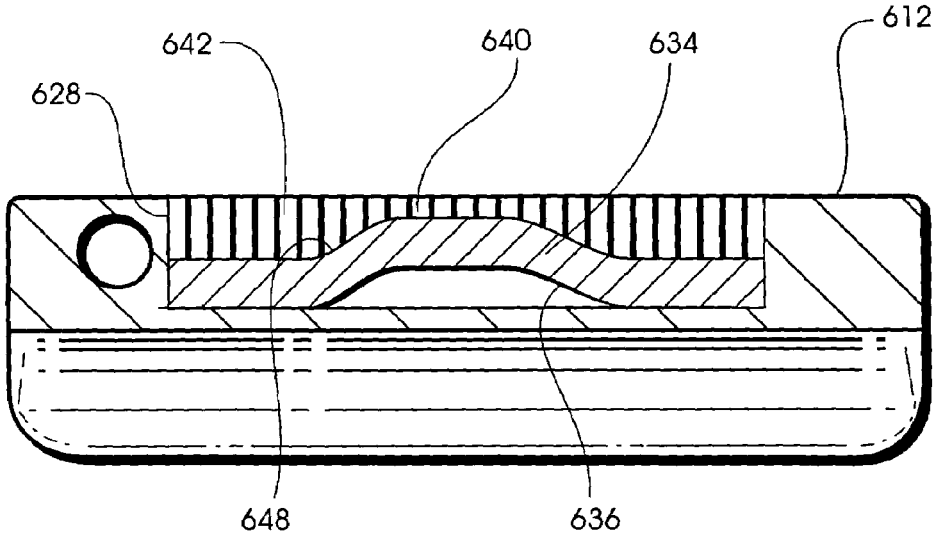
FIG. 6 is a cross-sectional view of yet another alternative embodiment of a golf club incorporating features of the present invention.

With reference to FIG. 6, another alternative embodiment of a golf club head incorporating features of the present invention comprises a club head body 612 having a cavity 628 formed therein. A first face insert 634 is disposed within the cavity 628. In the embodiment of FIG. 6, both the front surface 648 and back surface 636 are smoothly contoured to form an arch-like structure capable of substantial deflection without permanent deformation. Accordingly, the rod elements 642 that comprise second face insert 640 are able to "float" a substantial amount during the impact event with a golf ball and return to their pre-impact positions.

Figure 7:
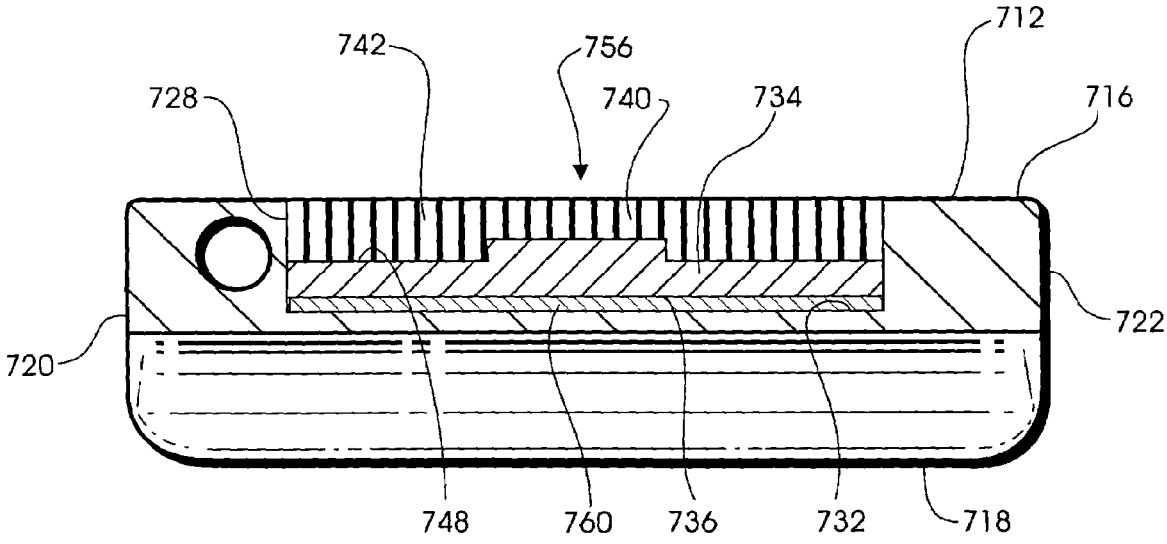
FIG. 7 is a cross-sectional view of yet another alternative embodiment of a golf club incorporating features of the present invention.

With reference to FIG. 7, yet another alternative embodiment of a golf club head incorporating features of the present invention comprises a club head body 712 having a front face 716, a rear surface 718, a heel end 720 and a toe end 722. A cavity 728 extends from the front face 716 toward the rear surface 718 and terminates in a bottom wall 732. First face insert 734 is disposed such that back surface 736 faces bottom wall 732 of cavity 728. Second face insert 740 which is composed of a plurality of rod elements is disposed in cavity 728 such that the rod elements are supported by front surface 748 of first face insert 734. A third face insert 760 is disposed in cavity 728 between the back surface 736 of first face insert 734 and bottom wall 732 of cavity 728. Third face insert 760 is preferably made of an elastomeric material the hardness of which has a lower durometer value than the hardness of first face insert 734. The combination of first face insert 734 and third face insert 760 provides a relatively non-compliant support for the rod elements 742 of first face insert 740 while providing a highly compliant support structure for the entirety of first face insert 740. In this case, the dynamic response across the face 756 of second face insert 740 is a composite of the resiliency and damping properties of the rod elements 742 the relatively non-complaint first face insert 734 and the highly complaint third face insert 760.

Although certain illustrative embodiments and methods have been disclosed herein, it will be apparent from the foregoing disclosure to those skilled in the art that variations and modifications of such embodiments and methods may be made without departing from the spirit and scope of the invention. Accordingly, it is intended that the invention should be limited only to extent required by the appended claims and the rules and principals of applicable law.

What is claimed is:

1. A golf club head comprising:

a body formed of a first material, said body having a front face, a rear surface and a cavity extending from the front face toward the rear surface, said cavity having a bottom surface;

a first face insert having a front surface, a back surface, a lateral surface and a thickness dimension measured between the front surface and the back surface, said first face insert disposed within the cavity with the back surface of said first face insert facing the bottom surface of the cavity; and a second face insert disposed within the cavity atop said first face insert, said second face insert including a plurality of elongate rod elements each having a first end wall, a second end wall and a side surface, said plurality of elongate rod elements arranged in a parallel closely packed array such that the side surface of each of said plurality of elongate rod elements is in contact with the side surface of an adjacent one of said plurality of elongate rod elements, with the first end walls of said plurality of elongate rod elements abutting the front surface of said first face insert and said second end walls of said plurality of elongate rod elements exposed to form a striking surface on the front face of the body.

2. The golf club head of claim 1, wherein the front surface of said first face insert is contoured to provide a non-planar support surface for the first end walls of said plurality of elongate rod elements to abut.

3. The golf club head of claim 2, wherein the thickness dimension of said first face insert varies from a thicker dimension proximal a center region of said first face insert to a thinner dimension proximal a perimeter region of said first face insert.

4. The golf club head of claim 2, wherein the thickness dimension of said first face insert varies from a thinner dimension proximal a center region of said first face insert to a thicker dimension proximal a perimeter region of said first face insert.

5. The golf club head of claim 1, wherein said first face insert is formed of a rigid material.

6. The golf club head of claim 5, wherein said rigid material comprises ceramic.

7. The golf club head of claim 5, wherein said rigid material comprises a metal alloy.

8. The golf club head of claim 1, wherein said first face insert is formed of an elastomeric material.

9. The golf club head of claim 8, wherein said elastomeric material comprises polyurethane.

10. The golf club head of claim 1, wherein said back surface of said first face insert is attached to the bottom surface of the cavity.

11. The golf club head of claim 1, further comprising a third face insert interposed between the back surface of said first face insert and the bottom surface of the cavity.

12. The golf club head of claim 11, wherein said first face insert and said third face insert are composed of different materials.

13. The golf club head of claim 11, wherein said first face insert is made of a rigid material and said third face insert is made of an elastomeric material.

14. The golf club head of claim 11, wherein said first face insert is made of an elastomeric material and said third face insert is made of a rigid material.

15. The golf club head of claim 1, wherein said first face insert comprises regions with different thickness dimensions.

16. The golf club head of claim 15, wherein said regions include a center region having one thickness dimension and a perimeter region having another thickness dimension.

17. The golf club head of claim 16, wherein the thickness dimension of said center region is greater than the thickness dimension of said perimeter region.

18. The golf club head of claim 16, wherein the thickness dimension of said center region is less than the thickness dimension of said perimeter region.

19. The golf club head of claim 1, wherein the bottom surface of the cavity includes an aperture opening to the rear surface of said body.

20. A golf club head comprising:

a body formed of a first material, said body having a front face, a rear surface and a cavity extending from the front face of the club head body toward the rear surface, said cavity having a bottom surface;

a first face insert formed of a second material, said first face insert having a front surface, a back surface, a lateral surface and a thickness dimension measured between the front surface and the back surface, said front surface and said back surface being non-parallel, said first face insert disposed within the cavity with the back surface of said first face insert abutting the bottom surface of the cavity; and a second face insert disposed within the cavity, said second face insert including a plurality of elongate rod elements each having a first end wall, a second end wall and a side surface, said plurality of elongate rod elements arranged in a parallel closely packed array such that the side surface of each of said plurality of elongate rod elements is in contact with the side surface of an adjacent one of said plurality of elongate rod elements, with the first end walls of said plurality of elongate rod elements abutting said front surface of said first face insert and said second end walls of said plurality of elongate rod elements exposed to form a striking surface on the front face of said body.

21. The golf club head of claim 20, wherein the front surface of said first face insert is contoured to form a non-planar surface.

22. The golf club head of claim 20, wherein the front surface of said first face insert forms a tapered planar surface relative to said back surface of said first face insert.

23. The golf club head of claim 20, wherein said second face insert is formed of a third material.

* * * * *